US006003564A

United States Patent [19]

Cahuzac et al.

[11] Patent Number: 6,003,564

[45] Date of Patent: Dec. 21, 1999

[54] WEAVING DEVICE FOR THE PRODUCTION OF A STRUCTURE FOR A COMPOSITE COMPONENT

[75] Inventors: Georges Jean Joseph Antoine Cahuzac, Bouscat; Jean-Marc Jacques Dupillier, Bordeaux; Lucien Fantino; François Jean Roger Monget, both of Merignac; Etienne Lemaire, Saint Medard En Jalles, all of France

[73] Assignee: Aerospatiale Societe Nationale Industrielle, Paris, France

[21] Appl. No.: 09/204,501

[22] Filed: Dec. 4, 1998

[30] Foreign Application Priority Data

Dec. 10, 1997 [FR] France ..... 97 15608

[51] Int. Cl.[6] ..... D03D 49/00; D03D 41/00; D03D 3/02

[52] U.S. Cl. ..... 139/97; 139/387; 139/11

[58] Field of Search ..... 139/11, 24, 32, 139/61, 76, 79, 97, 99, 103, 105, 107, 294, 295, 296, 309, 387

[56] References Cited

U.S. PATENT DOCUMENTS

| | | | |
|---|---|---|---|
| 2,998,030 | 8/1961 | Koppelman et al. | 139/387 |
| 3,746,051 | 7/1973 | Mohelnicky et al. | 139/11 |
| 4,055,697 | 10/1977 | Schmanski | 428/113 |
| 4,825,911 | 5/1989 | Pittman et al. | 139/291 |

FOREIGN PATENT DOCUMENTS 452685 11/1943 Belgium .

*Primary Examiner*—Andy Falik
*Assistant Examiner*—Robert H. Muromoto, Jr.
*Attorney, Agent, or Firm*—Fisher, Christen & Sabol

[57] ABSTRACT

Weaving device for producing a woven structure which is intended for the production of a composite component, including especially a component (5) for generating different speeds of movement for at least some of the warp yarns (FC). Component (5) includes a substantially plane profiled cam (5) capable of rotating about a longitudinal axis (X—X) and arranged so that the longitudinal axis (X—X) is approximately orthogonal to the direction (D) defined by the warp yarns (FC). The profile of the cam is defined by a variable transverse length (h) perpendicular to the longitudinal axis (X—X).

5 Claims, 3 Drawing Sheets

WEAVING DEVICE FOR THE PRODUCTION OF A STRUCTURE FOR A COMPOSITE COMPONENT

BACKGROUND OF THE INVENTION

The present invention relates to a woven structure for the production of a composite component as well as to a process and a device for producing such a woven structure.

Prior Art

It is known, in order to form a composite component, to impregnate the woven structure with a resin which is then cured or otherwise hardened, for example by raising the temperature or by electron bombardment.

More particularly, although not exclusively, such composite components are used in the aeronautical and space fields because of their excellent resistance to mechanical and/or thermal stresses. Very many applications may be envisaged, especially heat shields for bodies re-entering the atmosphere, solid-propellant rocket nozzles, aircraft brakes, helicopter rotor hubs, landing gear, wing roots, leading edges, etc.

However, as soon as the components to be produced are complex in form, with a variation in shape and/or in thickness, like most of the aforementioned components, it becomes complicated to produce them since it is then necessary to form, instead of a usual simple woven structure, suitable specific reinforcements intended to be embedded in the cured resin.

Many processes and devices have been conceived and developed for producing such generally complicated specific reinforcements but the automated manufacture of complex shaped components comes up against great difficulties which result in very complicated, and consequently expensive, machines without the components obtained necessarily always having all the required homogeneity and strength properties.

When the components have very complicated and varying shapes, it is therefore often necessary to make cuts in or to carry out subsequent machining on prefabricated components, thereby increasing, of course, the cost and reducing the mechanical strength.

In addition, such specific reinforcement s cannot in practice be produced by weaving since, in a known manner, a woven structure, usually produced by enlacing weft yarns in warp yarns that are moved longitudinally, always has a rectangular shape.

Consequently, there are two drawbacks in the a forementioned known prior art when the components to be produced have complex shapes:

- on the one hand, weaving is often precluded and complex processes have to be used to produce the suitable reinforcements; and
- on the other hand, treatments after the manufacture, such as machining operations, are generally required.

However, it should be pointed out that U.S. Pat. No. 2,998,030 describes a weaving process which uses means, such as a roller, for modifying the speeds of movement of the various warp yarns so as to obtain a woven structure of curvilinear shape.

SUMMARY OF THE INVENTION

The object of the present invention is to improve such a process in order to be able to weave complex components requiring only few subsequent treatments, or none at all.

To this end, according to the invention, the weaving device for producing a woven structure which is intended for the production of a composite component and which comprises weft yarns and warp yarns, said device including especially:

- means for moving the warp yarns longitudinally;
- means for enlacing the weft yarns in said warp yarns; and
- means for generating different speeds of movement for at least some of said warp yarns, is one in which said means for generating different speeds of movement comprise a profiled cam capable of rotating about a longitudinal axis, the profile of which cam is defined depending on the desired contour of at least a lateral edge of the woven structure to be produced, in which said cam has a substantially plane shape and a profile which is defined by a variable transverse length perpendicular to said longitudinal axis, and in which the cam is arranged so that said longitudinal axis is approximately orthogonal to the direction defined by the warp yarns.

In addition, advantageously, said profile is defined so that its transverse length hi, at a point Pi on the longitudinal axis, satisfies the following equation:

$$Li=\Sigma n(Pj)+F1(hi,\theta 2)-F2(hi,\theta 1),$$

in which:

- Li is the desired length of that warp yarn of the woven structure which is located at said point Pi on said longitudinal axis;
- n is the number of weft yarns of the woven structure;
- the n Pj are the movement steps of the warp yarns moved stepwise; and
- F1 and F2 are distances which depend on said transverse length hi and on the extreme angles θ1 and θ2 of rotation of the cam, respectively, during the movement of the warp yarns.

It should be pointed out that, by virtue of the present invention, the woven structure obtained may have a variable thickness which may be freely selected. Thus, by virtue of the invention, the shape of the woven structure may be modified, not only in a plane but also transversely to this plane, thereby allowing a three-dimensional structure of any shape to be created.

In the case of multilayer-type production according to the invention, in order to modify the thickness of the woven structure it is possible:

- to enlace a variable number of superposed weft yarns; and/or
- to enlace variable-diameter weft yarns; and/or
- to modify the length of the movement step of the warp yarns moved longitudinally stepwise, the weft yarns being enlaced at each step.

The figures of the appended drawing will make it clearly understood how the invention may be realized. In these figures, the same reference numbers and letters denote similar elements.

DESCRIPTION OF THE PREFERRED EMBODIMENTS

Figure 1:
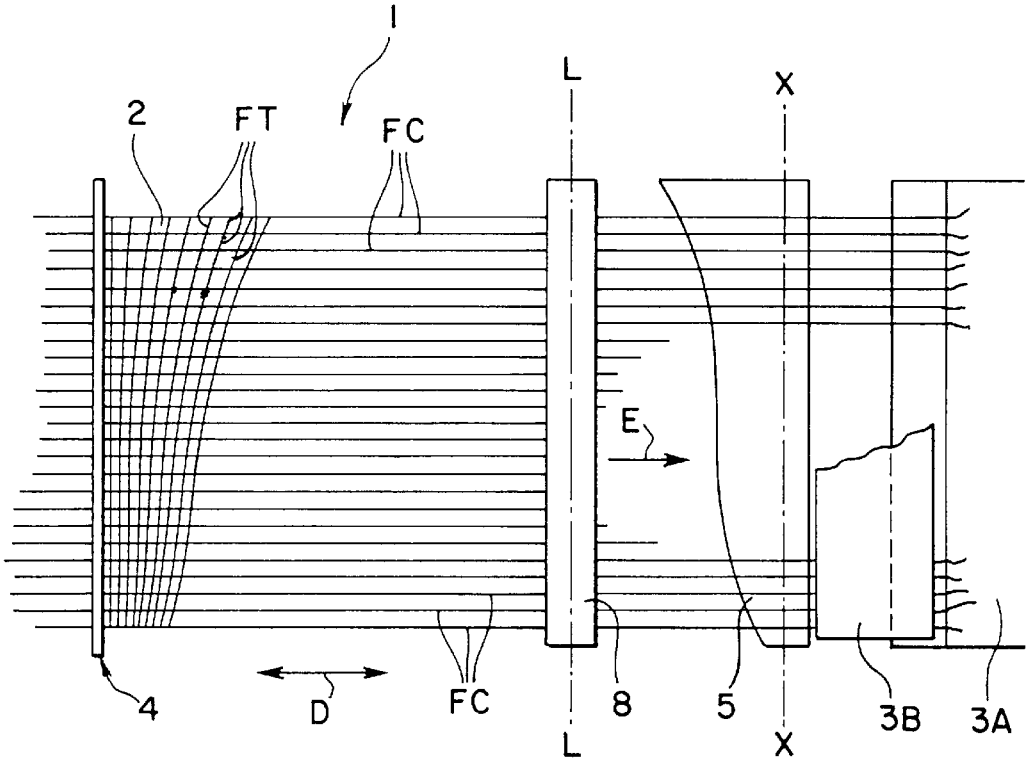
FIG. 1 is a diagrammatic top view of a device according to the invention.
Figure 2:
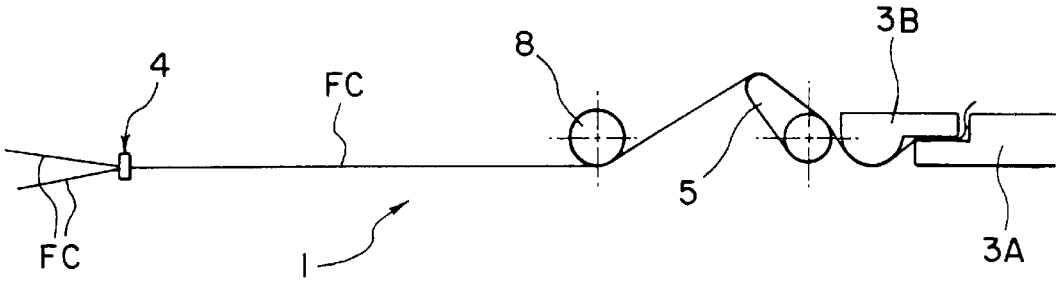
FIG. 2 is a diagrammatic side view of a device according to the invention.
Figure 3:
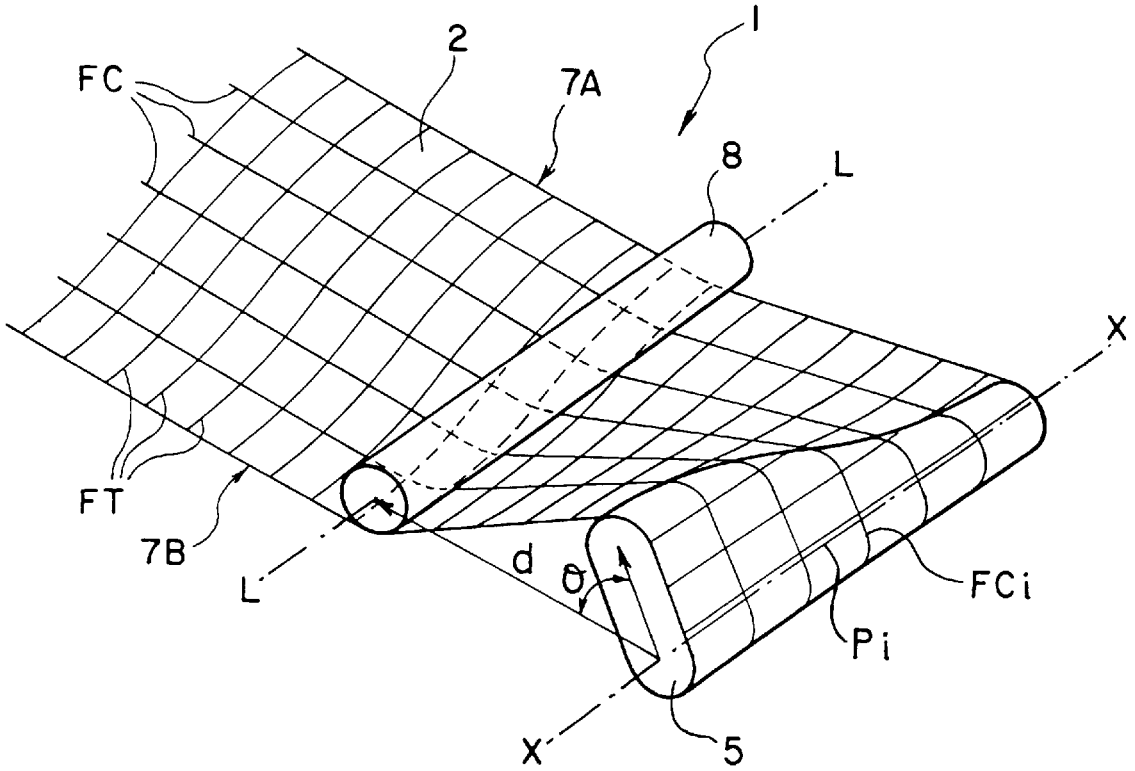
FIG. 3 shows, in perspective, part of a device according to the invention.

The weaving device 1 according to the invention and shown diagrammatically in FIGS. 1 to 3 is used to produce a woven structure 2, of the sheet type, which is formed from weft yarns FT and warp yarns FC and is intended for producing a composite component.

It is known that such a composite component is formed in the usual manner by said woven structure, which is embedded in a matrix of cured resin.

In a known manner, said device 1 especially includes:

means 3A and 3B for moving the warp yarns FC longitudinally stepwise, in a direction D. For this purpose, said means 3A and 3B have shaped parts which engage with each other, for example parts in the shape of steps, in order to hold said warp yarns FC in place, particularly by locking them; and means 4, comprising a beating reed for example, for enlacing said weft yarns FT in said warp yarns FC.

According to the invention, said device 1 also includes a cam 5 for generating different speeds of movement for at least some of said warp yarns FC.

All the elements 3A, 3B, 5 and the roller 8, which is explained below, are held fast and moved together, and the cam 5 rotates regularly by an increment of rotation when the warp yarns FC advance.

Figure 4:
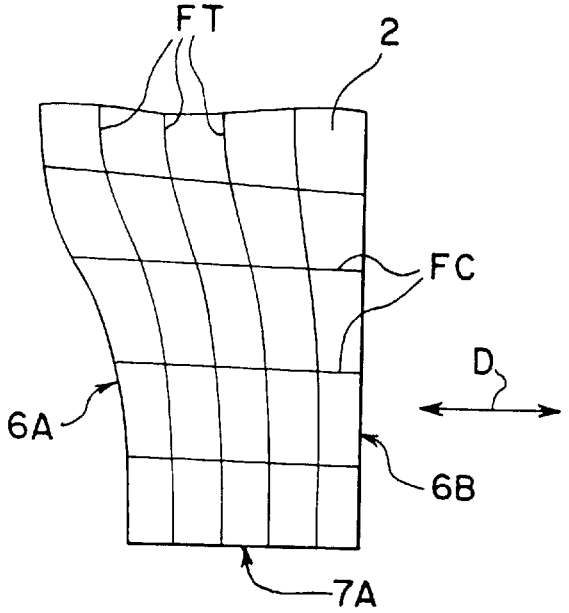
FIG. 4 shows diagrammatically part of a woven structure according to the invention.

Thus, these differences in speed result in a woven structure 2 having at least a lateral edge 6A along the weft yarns FT which is not perpendicular to the direction D defined by the warp yarns FC, as shown in FIG. 4.

Consequently, the shape of the woven structure 2 obtained by the device 1 is not rectangular since, although the longitudinal edges 7A and 7B along the warp yarns FC remain parallel, at least the lateral edge 6A is not perpendicular to said longitudinal edges 7A and 7B.

Of course, the adjectives "lateral" and "longitudinal" are defined with respect to the weft and warp yarns and not with respect to the final woven structure 2, the latter possibly having a greater length along the weft yarns than along the warp yarns.

According to the invention, said lateral edge 6A or the two lateral edges may be:

either in the form of a straight line so as to obtain a woven structure of trapezoidal shape;

or in the form of any curved line, as shown in FIG. 4.

Furthermore, according to the invention the profiled cam 5 is capable of rotating, at least partially, about an axis X—X orthogonal to the direction D and is placed upstream of the means 3A and 3B, in the direction E of movement or advance of the warp yarns FC, near said means 3A and 3B.

Figure 5:
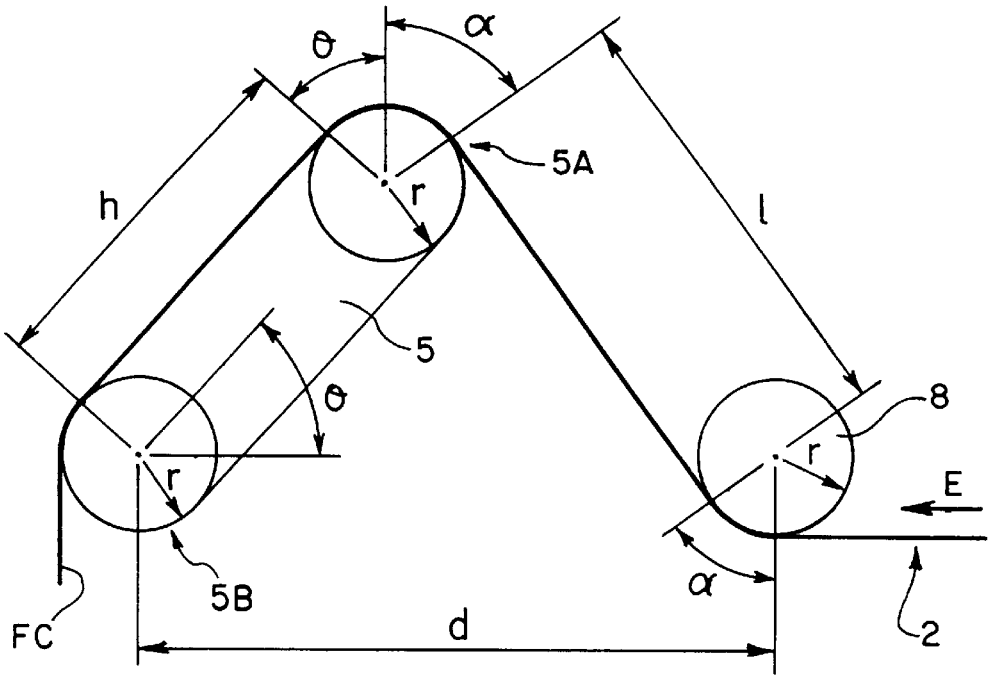
FIG. 5 is a graphical representation which explains how the profile of a cam according to the invention is determined.
Figure 6:
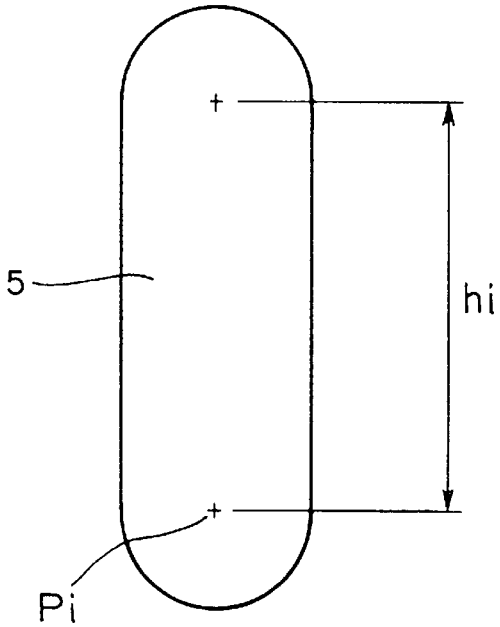
FIG. 6 is a vertical cross sectioned view of the profiled cam at point Pi on longitudinal axis (X—X) showing hi.

As may be seen in FIGS. 1 to 3, the device 1 according to the invention also includes the roller 8 which has its axis L—L parallel to the axis X—X and is placed at a distance d upstream of the axis X—X, as shown in FIG. 5.

Said profiled cam 5 of plane general shape has a profile tailored to the shape of the lateral edge 6A that it is desired to obtain, as will be explained below. Said profile is defined by a variable transverse length h perpendicular to said longitudinal axis X—X, as shown in FIG. 5.

Also indicated in this FIG. 5 are:

θ, the angle of rotation of the cam 5, the value of which lies between two limiting values θ1 and θ2 (not indicated);

r, the radius of the roller 8 as well as of the rounded ends 5A and 5B of the profiled cam 5, these having the same radius:

l, the length between the axis L—L of the roller 8 and the axis of the rounded end 5A of the profiled cam 5; and α, an angle which is defined by the tangency conditions of the warp yarn FC.

According to the invention, said profile of the cam 5 is defined so that its transverse length hi, at a point Pi on the longitudinal axis X—X, as shown in FIG. 3, satisfies the following equation:

$$Li=P\cdot n+F1(hi,\theta 2)-F2(hi,\theta 1)(EO)$$

in which:

Li is the desired length of that warp yarn FCi of the woven structure 2 which is located at said point Pi on said longitudinal axis X—X;

n is the number of weft yarns FT of the woven structure 2;

P is the step in the movement of the warp yarns FC under the action of the means 3A, which step occurs each time a weft yarn FT is put into place and which is assumed to be constant; and F1 and F2 are distances which will be explained below and depend on said transverse length hi and on said extreme angles θ1 and θ2 of rotation of the cam 5, respectively.

Of course, the resulting length of the product P.n may be defined differently if the step P in the movement or advance of the warp yarns FC is not constant, namely by simply summing the lengths of the various steps.

According to the invention, the aforementioned parameters h, d, r, θ1 and θ2 are optimized in order to achieve the best possible distribution uniformity of the weft yarns FT between the lateral edges 6A and 6B of the woven structure 2.

The method of calculating the functions F1 and F2 will be explained below. Since the calculation is the same for both functions, it will be explained based on a function F dependent on an angle θ. To obtain F1 and F2, all that is required in this function F is to replace θ by θ1 and θ2, respectively.

From geometrical equations and from the illustration in FIG. 5, and by assuming that:

the woven structure 2 does not slip from the cam 5 in the direction X—X;

the warp yarns FC are inelastic; and the thickness of the woven structure 2 is constant and independent of the tension and of the pressure, the following equation may be readily derived:

$$F = r + r\left(\frac{\pi}{2} - \theta\right) + h + r(\alpha + \theta) + 1 + r\alpha,$$

which may be written as:

$$F = r\left(1 + \frac{\pi}{2} + 2\alpha\right) + h + 1.$$

In this second equation, r, h, θ and d are variable parameters to be chosen, and l and α are unknowns which may be calculated, as explained below.

By carrying out a double projection, respectively onto a horizontal axis and a vertical axis (these not being shown), the following two equations are obtained:

$$d=-r\sin\theta+h\cos\theta+r\sin\theta+r\sin\alpha+l\cos\alpha+r\sin\alpha \quad (1)$$

$$0=r+r\cos\theta+h\sin\theta+r(1-\cos\theta)-r(1-\cos\alpha)-l\sin\alpha-r(1-\cos\alpha) \quad (2)$$

which simplify to:

$l\cos\alpha+2r\sin\alpha=d-h\cos\theta$ in the case of (1) and $l\sin\alpha-2r\cos\alpha=h\sin\theta$ in the case of (2).

By calculating (Equation 1)$^2$+(Equation 2)$^2$, we obtain $$l^2=4r^2=d^2+h^2-2dh\cos\theta,$$

i.e.:

$$l=\sqrt{d^2+h^2-4r^2-2dh\cos\theta}.$$

From (Equation 1)$\sin\alpha$+(Equation 2)$\cos\alpha$, we furthermore obtain:

$$2r=(d-h\cos\theta)\sin\alpha-h\sin\theta\cos\alpha,$$

i.e.:

$$\alpha=\arcsin\left(\frac{2r}{\sqrt{d^2+h^2-2dh\cos\theta}}\right)+\arcsin\left(\frac{h\sin\theta}{\sqrt{d^2+h^2-2dh\cos\theta}}\right).$$

From the above, we can calculate l and $\alpha$, and therefore we can form the function F from the parameters of r, h, d and $\theta$.

Consequently, by taking specific values of r, d, $\theta1$ and $\theta2$ and by using said function F and the aforementioned Equation (EO), the distance hi of each point Pi in question may be derived, that is to say the profile of the cam 5 may be defined.

It will also be noted that, in the weaving device 1 used according to the invention, each warp yarn FC is wound on an independent bobbin (not shown) so as to deliver different lengths of yarn, as specified and required by said device 1.

The device 1 according to the invention also allows the thickness of the woven structure 2 to be modified, especially in the case of the production of a multilayer structure.

To do this, i.e. to obtain a variable thickness, according to the invention:

superposed weft yarns FT, varying in number and/or in diameter, are enlaced at each step in the movement of the device 1; and/or the length of the step P in the movement or advance of the warp yarns FC is varied.

To do this, all that is required is to correspondingly form, in particular, the aforementioned means 4.

Thus, by virtue of the invention, woven structures 2 of variable shape and thickness may be produced. It is therefore possible to preform the woven structures 2 according to the composite components to be manufactured, thereby considerably reducing the number of subsequent treatments, of the machining type, which said components then undergo.

Moreover, the device 1 according to the invention is simple both to produce and to use and is inexpensive.

We claim:

1. A weaving device for producing a woven structure which is intended for the production of a composite component and which comprises weft yams (FT) and warp yams (FC), said device (1) including:

means (3A, 3B) for moving said warp yams (FC)

means (4) for enlacing the weft yams (FT) in said warp yams (FC); and means (5) for generating different speeds of movement for at least some of said warp yams (FC), wherein said means (5) for generating different speeds of movement comprise a profiled cam (5) capable of rotating about a longitudinal axis (X—X), the profile of which cam is defined depending on the contour of at least a lateral edge (6A) of the woven structure (2) to be produced, wherein said cam (5) has a substantially plane shape in plane of said cam (5) passing through said longitudinal axis (X—X), and said profile which is defined by a variable transverse length h perpendicular to said longitudinal axis (X—X), an upper end of said variable transverse length h being a constant distance from an edge of said cam opposite said longitudinal of axis (X—X), and wherein the cam is arranged so that said longitudinal axis (X—X) is approximately orthogonal to a direction (D) defined by the warp warns (FC).

2. The device as claimed in claim 1, wherein said profile is defined so that the transverse length hi of said profile, at a point Pi on the longitudinal axis (X—X), satisfies the following equation:

$$Li=\Sigma n(Pj)+F1(hi,\theta2)-F2(hi,\theta\cdot1),$$

in which:

Li is the desired length of warp yarn (FCi) of the woven structure (2) which is located at said point Pi on said longitudinal axis (X—X);

n is the number of weft yamns (FT) of the woven structure (2);

the n (Pj) are movement steps of the warp yarns (FC) moved stepwise; and

F1 and F2 are distance which depend which depend on said transverse length hi and on extreme angles $\theta1$ and $\theta2$ of rotation of the cam (5), respectively.

3. The device as claimed in claim 1, for producing a woven structure having a variable thickness, wherein said means (4) for enlacing weft yarns (FT) enlace a variable number of superposed weft yarns (FT).

4. The device as claimed in claim 1, for producing a woven structure having a variable thickness, wherein said means (4) for enlacing weft yarns (FT) enlace variable-diameter weft yarns (FT).

5. The device as claimed in claim 1, for producing a woven structure having a variable thickness, wherein said device includes means for modifying the length of movement step of the warp yarns (FC) moved longitudinally stepwise, the weft yarns (FT) being enlaced at each step.

* * * * *